US011560740B2

(12) United States Patent
Rea et al.

(10) Patent No.: US 11,560,740 B2
(45) Date of Patent: Jan. 24, 2023

(54) LATCH ASSEMBLY

(71) Applicant: Faurecia Interior Systems, Inc., Auburn Hills, MI (US)

(72) Inventors: Julien Rea, Sunnyvale, CA (US); Cedric Ketels, Mountain View, CA (US); Justin Landowne, Exeter, NH (US)

(73) Assignee: Faurecia Interior Systems, Inc., Auburn Hills, MI (US)

( * ) Notice: Subject to any disclaimer, the term of this patent is extended or adjusted under 35 U.S.C. 154(b) by 235 days.

(21) Appl. No.: 16/907,774

(22) Filed: Jun. 22, 2020

(65) Prior Publication Data

US 2021/0396053 A1 Dec. 23, 2021

(51) Int. Cl.

| | |
|---|---|
| ***E05B 81/04*** | (2014.01) |
| ***E05B 83/32*** | (2014.01) |
| ***E05B 47/00*** | (2006.01) |

(52) U.S. Cl.

CPC ..... *E05B 81/04* (2013.01); *E05B 47/0009* (2013.01); *E05B 83/32* (2013.01); *E05Y 2900/538* (2013.01)

(58) Field of Classification Search

CPC ..... Y10T 292/1076; Y10T 292/1082; Y10T 292/1043; E05B 81/04; E05B 47/0009; E05B 83/32; E05B 65/104; E05Y 2900/538; Y10S 292/11; B60R 7/04; B60R 7/43; B60R 7/06; B60R 7/46

USPC ..... 296/23.34, 37.8, 37.12

See application file for complete search history.

(56) References Cited

U.S. PATENT DOCUMENTS

| | | | | |
|---|---|---|---|---|
| 3,873,881 | A | 3/1975 | Inoue | |
| 8,915,524 | B2 | 12/2014 | Charnesky et al. | |
| 9,863,171 | B1 * | 1/2018 | Salter | B60R 7/04 |
| 9,937,827 | B1 * | 4/2018 | Choi | B60N 2/99 |
| 10,435,918 | B2 | 10/2019 | Weber et al. | |
| 2006/0172557 | A1 * | 8/2006 | He | E05B 81/00 439/34 |
| 2008/0100079 | A1 * | 5/2008 | Herrera | G07C 9/00912 296/37.1 |
| 2009/0066102 | A1 * | 3/2009 | Shiono | E05B 83/32 296/24.34 |
| 2010/0066113 | A1 | 3/2010 | Browne et al. | |

(Continued)

FOREIGN PATENT DOCUMENTS

| | | | | |
|---|---|---|---|---|
| DE | 10109827 | B4 * | 4/2006 | E05B 79/20 |
| DE | 102010009380 | A1 | 9/2011 | |

(Continued)

*Primary Examiner* — Kristina R Fulton
*Assistant Examiner* — Steven A Tullia
(74) *Attorney, Agent, or Firm* — Reising Ethington P.C.

(57) ABSTRACT

A latch assembly for a vehicle, in applications such as an armrest console or a glove box, includes a shape memory alloy (SMA) actuator. The SMA actuator includes an actuator housing, an SMA wire, and an actuator lever arm. The actuator lever arm is configured to pivotably rotate or linearly translate with respect to the actuator housing upon activation of the SMA wire. A connecting link is coupled to the actuator lever arm. The connecting link is configured to translate linearly along a connecting link axis when the actuator lever arm pivotably rotates or linearly translates. A striker is coupled to the connecting link and configured to rotate about a striker axis to engage a closing surface.

14 Claims, 4 Drawing Sheets

(56) References Cited

U.S. PATENT DOCUMENTS

| | | | | |
|---|---|---|---|---|
| 2012/0187128 | A1 | 7/2012 | Weber et al. | |
| 2015/0300055 | A1 | 10/2015 | Alexander et al. | |
| 2016/0001684 | A1* | 1/2016 | An | B60N 2/763 296/37.5 |
| 2016/0003275 | A1* | 1/2016 | An | B60N 2/793 403/322.4 |
| 2016/0339847 | A1* | 11/2016 | Kodama | B60R 7/04 |
| 2018/0009387 | A1* | 1/2018 | Kwon | B60N 2/773 |
| 2018/0129251 | A1* | 5/2018 | Gault | G06F 21/86 |
| 2020/0040609 | A1* | 2/2020 | Alexander | E05B 81/04 |

FOREIGN PATENT DOCUMENTS

| | | | | |
|---|---|---|---|---|
| DE | 102012000913 | A1 | 7/2013 | |
| FR | 2655598 | A1 | 6/1991 | |
| FR | 2820174 | A1 * | 8/2002 | E05B 47/0009 |
| KR | 100521224 | B1 | 10/2005 | |
| WO | WO-2006055618 | A2 * | 5/2006 | E05B 81/04 |
| WO | WO-2010062235 | A1 * | 6/2010 | F16B 1/04 |
| WO | WO-2018225506 | A1 * | 12/2018 | E05B 79/20 |

* cited by examiner

LATCH ASSEMBLY

TECHNICAL FIELD

The present disclosure is related generally to latch assemblies for vehicles and, more particularly, to latch assemblies that utilize a shape memory alloy (SMA) actuator.

BACKGROUND

Shape memory alloy (SMA) actuators can be used to facilitate movement of one or more components in a latch assembly. For example, U.S. Pat. No. 10,435,918 to Weber et al. discloses a latch system that includes an SMA wire which contracts when current is applied to it. The contraction of the SMA wire pulls a rocker and ultimately rotates an engagement element to open the storage compartment. Strategic decoupling of the interface between the engagement element or striker and the SMA wire can improve performance of the latch assembly.

SUMMARY

An illustrative latch assembly for a vehicle includes a shape memory alloy (SMA) actuator having an actuator housing, an SMA wire, and an actuator lever arm. The actuator lever arm is configured to pivotably rotate or linearly translate with respect to the actuator housing upon activation of the SMA wire. A connecting link is coupled to the actuator lever arm. The connecting link is configured to translate linearly along a connecting link axis when the actuator lever arm pivotably rotates or linearly translates. A striker is coupled to the connecting link, and the striker is configured to rotate about a striker axis to engage a closing surface.

In some embodiments, the connecting link includes a wrapping end to couple the actuator lever arm.

In some embodiments, at least a portion of the shape memory alloy (SMA) wire runs parallel to an actuator housing axis that extends along a longest length of the actuator housing.

In some embodiments, the actuator lever arm is configured to pivotably rotate with respect to the actuator housing.

In some embodiments, an actuation range for pivotable rotation of the actuator lever arm is between 10° and 25°, inclusive.

In some embodiments, the actuation range overlaps an actuator lever arm axis, and the actuator lever arm axis is orthogonal to the actuator housing axis.

In some embodiments, the actuator housing axis is aligned with the connecting link axis.

In some embodiments, the actuator lever arm linearly translates upon activation of the shape memory alloy (SMA) wire.

In some embodiments, there is a decoupled interface between the striker and the shape memory alloy (SMA) actuator, and the decoupled interface decouples movement of the striker from movement of the SMA wire.

In some embodiments, the shape memory alloy (SMA) actuator includes a return spring, and the decoupled interface allows for the return spring and the SMA wire to return to original positions at different rates of speed.

In some embodiments, the striker includes a locking pawl and a connection extension.

In some embodiments, the connection extension has an open track to slidingly accommodate the connecting link.

In some embodiments, a center console for a vehicle comprises a latch assembly.

In some embodiments, the closing surface is located on an armrest.

In some embodiments, a glovebox for a vehicle comprises a latch assembly.

It is contemplated that any number of the individual features of the above-described embodiments and of any other embodiments depicted in the drawings or description below can be combined in any combination to define an invention, except where features are incompatible.

BRIEF DESCRIPTION OF THE DRAWINGS

Illustrative embodiments will hereinafter be described in conjunction with the following figures, wherein like numerals denote like elements, and wherein.

DESCRIPTION OF ILLUSTRATIVE EMBODIMENTS

Described herein are embodiments of latch assemblies for use in various vehicle-based applications, such as with consoles, armrests, glove boxes, other storage compartments, and other implementations such as a headrest. The latch assemblies strategically employ a shape memory alloy (SMA) wire in an SMA actuator that cooperates with a connecting link and a striker to facilitate opening and/or closing of the vehicle compartment, for example. The SMA actuator disclosed herein can provide a cost-effective solution that also improves packaging and noise. As compared with a solenoid actuator, for example, the latch assembly with the SMA actuator described herein can be much quieter, lighter, and smaller. The arrangement and operability of the various components of the SMA actuator can result in improved performance of the latch assembly. A strategically decoupled interface between the SMA actuator and the striker of the latch assembly allows for a return spring and the SMA wire to return to their original positions at different rates without moving the striker. Furthermore, the temporary movement of the striker when the storage compartment is closed does not impact the SMA actuator.

Figure 1:
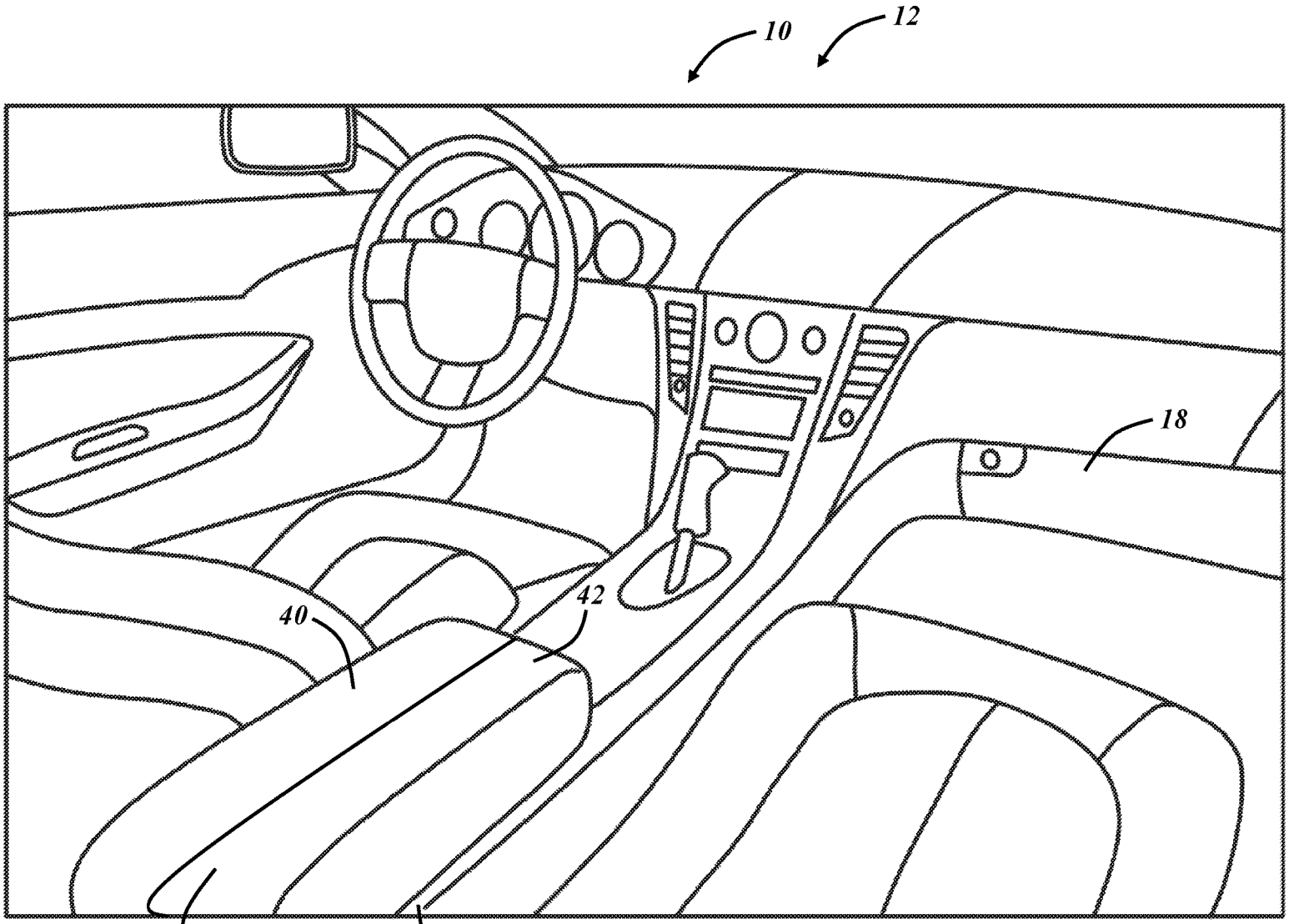
FIG. 1 is a perspective view of the interior of a vehicle passenger cabin showing various storage compartments equipped with a latch assembly.

FIG. 1 is a perspective view of an interior of a passenger cabin 10 of a vehicle 12 including various types of storage compartments that can use the latch assemblies described herein. Example storage compartments include a center console 14 having an armrest 16 and a glovebox 18; however, it is possible to use the latch assemblies of the present disclosure in other implementations. Further, while the present disclosure is more focused on the latch assembly used with the console 14 and armrest 16, the various features and attributes of the latch assembly may also be used, and may be adapted for use with, other storage compartments such as the glovebox 18 or other actuatable components.

Figure 2:
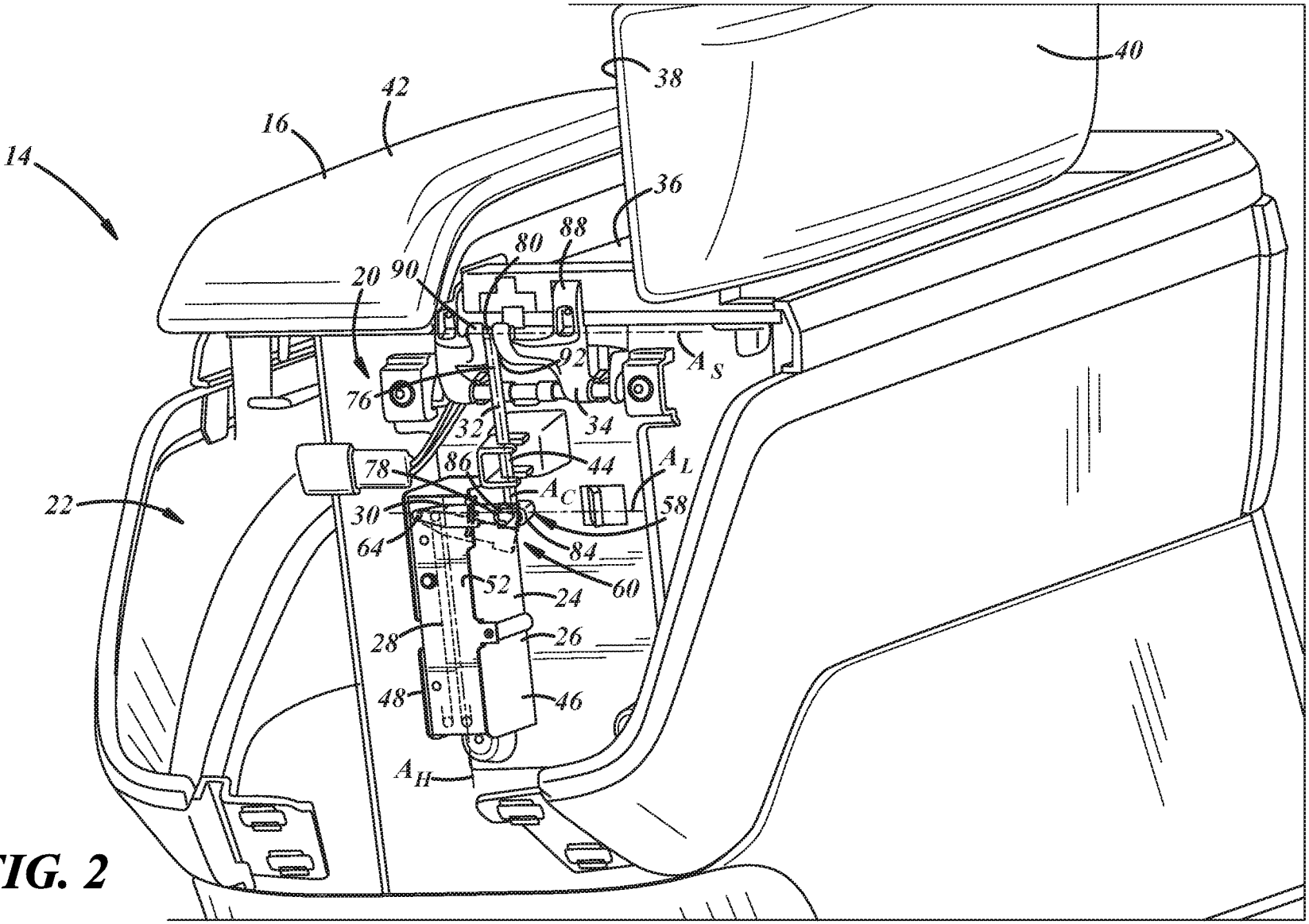
FIG. 2 shows the interior of the armrest center console and latch assembly of FIG. 1.

FIG. 2 illustrates the latch assembly 20. In FIG. 2, a front cover is removed from the center console 14 in order to show an interior region 22 where the latch assembly 20 is housed. The latch assembly 20 includes an SMA actuator 24, which includes an actuator housing 26, an SMA wire 28 located inside the actuator housing 26, and an actuator lever arm 30. The actuator lever arm 30 is configured to pivotably rotate or linearly translate with respect to the actuator housing upon activation of the SMA wire 28. A connecting link 32 is coupled to the actuator lever arm 30, and a striker 34 is coupled to the connecting link 32. "Coupled" as used herein can be a direct coupling, where one component is fixedly or directly attached to another component, or it can be an indirect coupling, with one or more other subcomponents located therebetween, to help facilitate attachment, for example. Additionally, "coupled" may also include an arrangement where one component bears on another component.

In operation, when users desire to open the armrest 16 to access a storage compartment 36 in the center console 14, they can press a button or some other trigger, actuation device, etc. which will ultimately cause current to be applied to the SMA wire 28. As the SMA wire 28 contracts, it moves the actuator lever arm 30. The actuator lever arm 30 pulls the connecting link 32, which rotates the striker 34. The striker 34 engages a closing surface 38 on the inner side of the armrest 16. The closing surface 38 may include a small groove, recess, pocket, etc. for accommodating the striker 34. In the illustrated embodiment, the armrest 16 includes two panels 40, 42. In other embodiments, there may be only one panel, or more than two panels. The latch assembly 20 operates to facilitate opening and/or secure closing of the first panel 40. It is possible to include a second latch assembly to facilitate opening and/or secure closing of the second panel 42, or it may also be feasible to have one latch assembly that secures both panels 40, 42. Other lidded arrangements are certainly possible.

Figure 3:
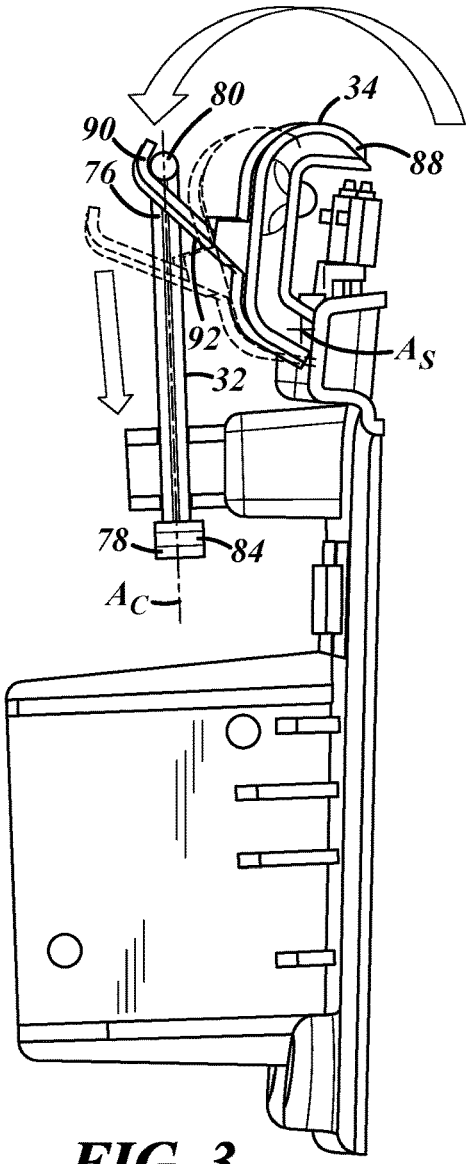
FIG. 3 is a side view of the connecting link and the striker of a latch assembly.

FIG. 3 illustrates movement of the connecting link 32 and the striker 34 during operation of the latch assembly 20. The connecting link 32 is configured to translate linearly along a connecting link axis $A_C$ when the actuator lever arm 30 (not shown in FIG. 3) pivotably rotates or linearly translates. This causes the striker 34 to rotate about a striker axis $A_S$ to engage the closing surface 38. The connecting link axis $A_C$ runs along a longest length or extent of the connecting link 32. The striker axis $A_S$ extends through the center of rotation of the striker 34. The connecting link axis $A_C$ is generally orthogonal to the striker axis $A_S$ in the illustrated embodiments. Movement of the connecting link 32 and the striker 34 with respect to the axes $A_C$ and $A_S$ is facilitated by the SMA actuator 24.

Figure 4:
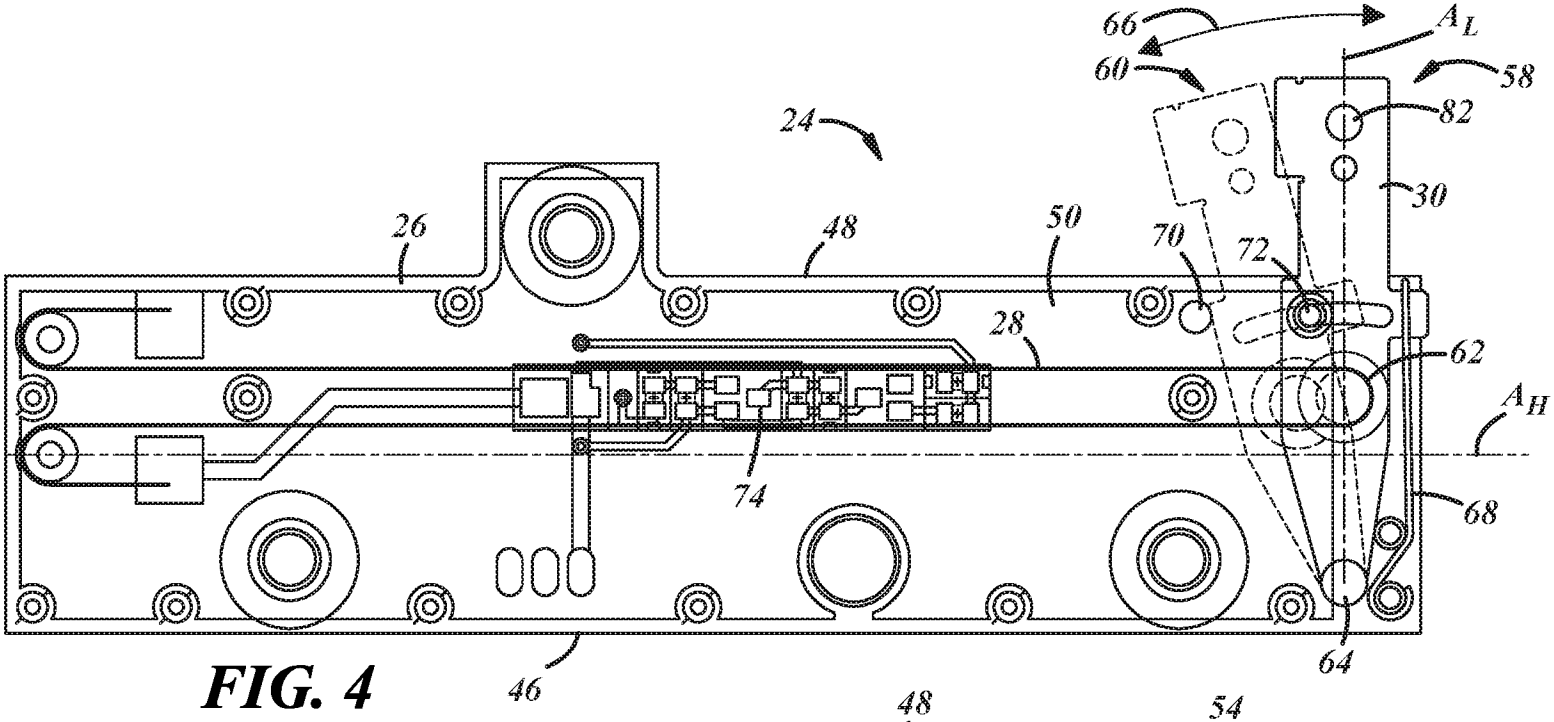
FIG. 4 shows the shape memory alloy (SMA) actuator of the latch assembly of FIGS. 1 and 2.

FIG. 4 illustrates one embodiment of the SMA actuator 24 that can be used with the latch assembly 20 illustrated in FIG. 2. The SMA actuator 24 is positioned to couple with the connecting link 32 such that the force applied by the SMA actuator 24 ultimately causes the striker 34 to move and provide access to the storage compartment 36. Thus, the connecting link 32 helps form a decoupled interface 44 between the SMA actuator 24 and the striker 34. Additionally, movement of the actuator lever arm 30 also helps to form the decoupled interface 44 between the SMA wire 28 and the striker 34.

Figure 5:
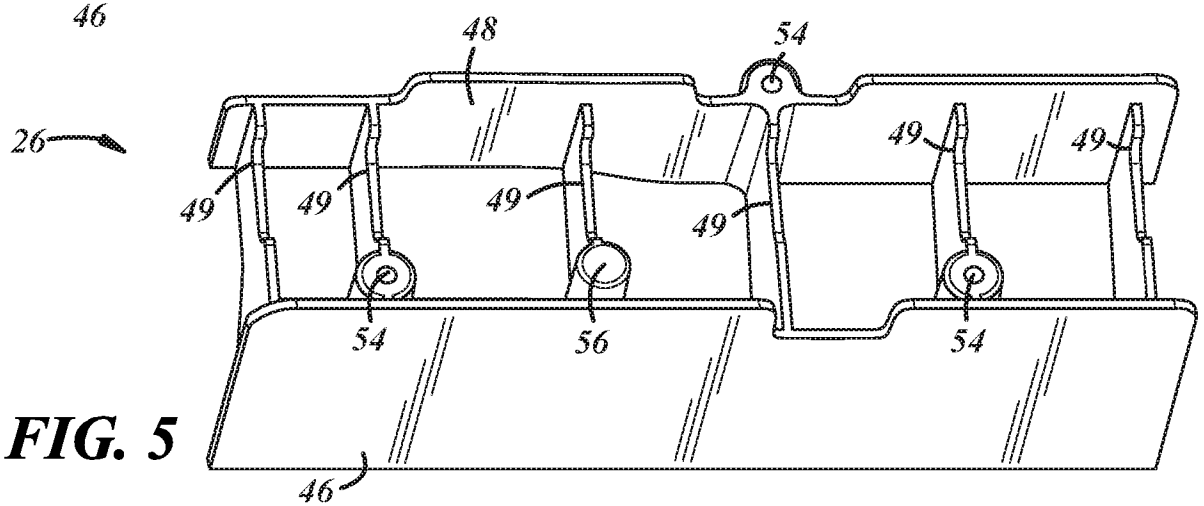
FIG. 5 shows one embodiment of an actuator housing for an SMA actuator.

The SMA actuator 24 includes an actuator housing 26, an SMA wire 28, and an actuator lever arm 30. One embodiment of an actuator housing 26 is illustrated in FIG. 5. The actuator housing 26 includes two longitudinally extending side walls 46, 48 that are joined by a plurality of support ribs 49. The ribs 49 provide further support for the body of the SMA actuator 24. In some embodiments, the ribs 49 support a printed circuit board (PCB) 50 to which the SMA wire 28 is mounted (see e.g., PCB 50 in FIG. 4). One or more backing plates 52 (as shown in FIG. 2) can be mounted to the housing 26 to help shield the internal components such as the PCB 50 and the SMA wire 28. Screw holes 54 may be used to attach the backing plate 52, and one or more locator pins 56 can provide physical reference for easy assembly. The actuator housing 26 may be made from a rigid plastic or some other operable material. In some embodiments, the housing 26 may merely be the PCB 50 or some other component on which the other components of the actuator 24 are attached.

The SMA wire 28 is constructed from a shape memory alloy material, which varies in length depending on the temperature of the material. Thus, when a current is applied to the SMA wire 28, it heats and contracts, which pulls the actuator lever arm 30. The shape memory alloy material reversibly switches material states (e.g., between martensite and austenite) to cause the contraction and motion of the actuator lever arm 30. Cooling of the SMA wire 28 causes the wire to return to its original position. The original position 58 is shown in FIG. 4 along with the retracted position 60 in dotted lines. Two example shape memory alloy materials that may be used for the wire 28 include copper-aluminum-nickel and nickel-titanium; however, other shape memory alloy materials are certainly possible.

The SMA wire 28 is mounted on the PCB 50 such that it loops around or is otherwise attached to an anchor 62 on the actuator lever arm 30. At least a portion of the SMA wire 28 runs parallel to the actuator housing axis $A_H$. The anchor 62 for coupling the SMA wire 28 to the lever arm 30 is a washer; however, other ways to anchor the wire 28 to the lever arm 30 are certainly possible. When the SMA wire 28 contracts, the anchor 62 is pulled by the SMA wire and the actuator lever arm 30 rotates at the pivot point 64. Thus, the actuator lever arm 30 is configured as an output-stage lever arm to pivotably rotate with respect to the actuator housing 26 upon activation of the SMA wire 28. An actuation range 66 for pivotable movement of the actuator lever arm 30 is at least partially defined by a return spring 68 and an end stop 70. The return spring 68 is a bias spring which aids in retraction of the lever arm 30 and wire 28 when the voltage is turned off. The actuation range 66 for pivotable rotation of the actuator lever arm 30 is advantageously between 10° and 25°, inclusive. In the illustrated embodiment, the actuation range 66 is 14°. The actuation range 66 overlaps an actuator lever arm axis $A_L$, which is an axis that lengthwise divides the actuator lever arm 30 along its longest length or extent when the lever arm is at its original position 58. The actuator lever arm axis $A_L$ is orthogonal to the actuator housing axis $A_H$ in the original position 58. Additionally, in the original position 58, the anchor 62 and the pivot point 64 are both aligned along the actuator lever arm axis $A_L$. This arrangement, where the actuator lever arm axis $A_L$ is orthogonal to the actuator housing axis $A_H$ at the original position 58, can provide for improved mounting of the latch assembly 20. Further, having the actuator lever arm 30 extend orthogonally from the housing 26 along the actuator lever arm axis $A_L$ can help regulate the force output while maintaining a smaller, thinner overall package for fitting into a compact area.

In this embodiment, the SMA wire 28 contracts a few millimeters (about 3-5% of its length) when actuated. Actuation of the SMA wire 28 may be triggered by a button on the console 14, on the instrument panel, or by some other operable means (e.g., voice activation). Power may be supplied to the SMA actuator 24 and the SMA wire 28 through the vehicle power supply or through a separate low voltage battery, to cite a few examples. The arrangement of the actuator lever arm 30 with respect to the housing 26 and the SMA wire 28 multiplies the stroke to achieve an output stroke of approximately 10 mm. The output force at the end of the lever arm 30 is approximately 10 N. After contraction, the SMA wire 28 retracts to its original position within about 5 seconds, aided by the return spring 68. In one example embodiment, the SMA wire 28 is activated with about 3-15V (Vcc). Higher voltages have the potential of decreasing actuation time. With the Vcc and ground leads connected, a logic-level signal is sent to a MOSFET transistor driver circuit. The driver applies the desired voltage (Vcc) to the SMA wire 28. The signal can also be pulse-width-modulated (PWM) to simulate a voltage lower than Vcc. To help prevent the application of a high voltage that could burn out the wire 28, the end stop 70 along with a second end stop 72 help to electromechanically limit the applied voltage. When the lever arm 30 reaches the predetermined end of its stroke or the end of the actuation range 66, one of the end stops 70, 72 will be contacted by the lever arm. This signals to the control electronics 74, which are advantageously housed within the housing 26, to momentarily stop the voltage and then reapply the voltage. This on-and-off modulation can help prevent the SMA wire 28 from overheating. Other mechanisms for cooling the SMA wire 28 may also be included, such as a cooling jacket, heat sink, etc.

The decoupled interface 44 between the SMA wire 28 and the striker 34 allows for the SMA wire 28 to retract/extend without affecting the striker 34. This allows the return spring 68 and the SMA wire 28 to return to their original positions at different rates without impacting the latch assembly 20. Further, when the panel 40 of the armrest 16 is closed, the striker 34 temporarily moves until it engages with a notch or the like in the closing surface 38 and the latch assembly 20 locks again. This temporary movement does not impact the SMA actuator 24 given the decoupled interface 44. To form the decoupled interface 44, the actuator lever arm 30 is coupled to the connecting link 32 which is then coupled to the striker 34.

The connecting link 32 has a main rod body 76 situated between a wrapping end 78 and a striker interface end 80. The wrapping end 78 is operably coupled to the actuator lever arm 30. A fastener may extend through an attachment recess 82 located in a distal end of the actuator lever arm 30 and arms 84, 86 of the wrapping end 78 may extend around the fastener in order to couple the wrapping end and the actuator lever arm. With particular reference to FIG. 3, the striker interface end 80 has an anvil-like shape that cooperates with the striker 34. More particularly, the striker 34 has a locking pawl 88 and a connection extension 90 extending from the locking pawl 88. The connection extension 90 has an open track 92 to slidingly accommodate the striker interface end 80 of the connecting link 32. The connecting link 32 and the striker 34 may have different configurations than those particularly illustrated. For example, the connecting link may be a wire or have some other operable form. The striker 34 may have two locking pawls 88, as shown in FIG. 2, or it may have 1 as shown in FIG. 3, or it may have more than two. Other configurational adjustments are certainly possible.

Figure 6:
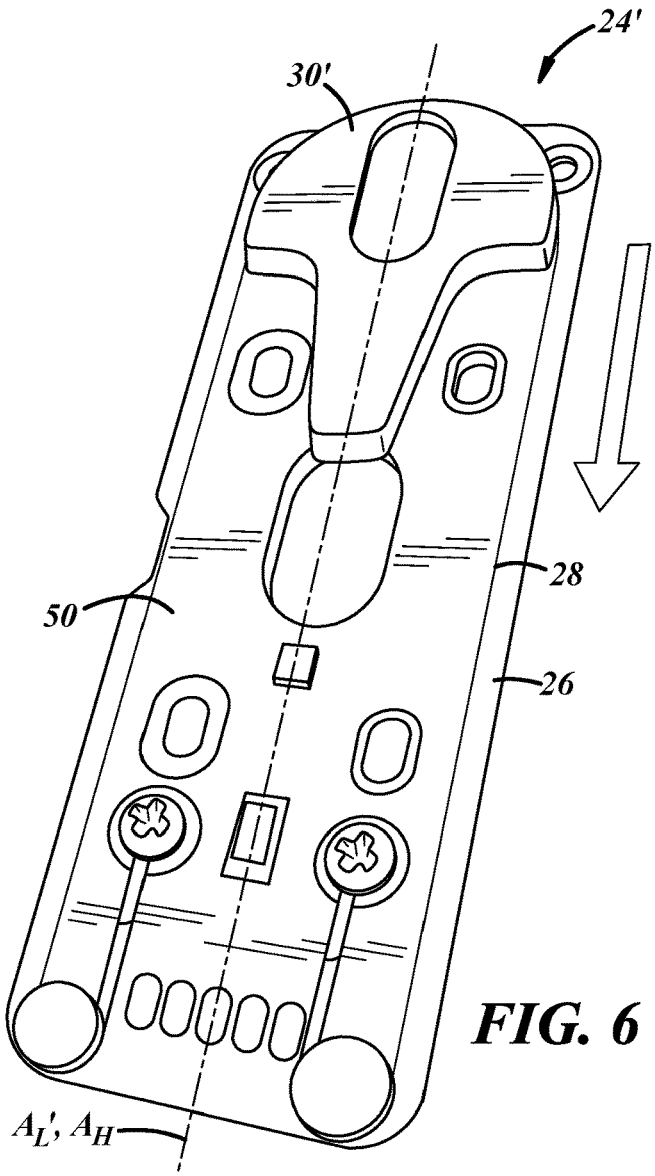
FIG. 6 illustrates another embodiment of an SMA actuator lever arm.

FIG. 6 illustrates another embodiment of an SMA actuator 24'. In this embodiment, the actuator lever arm 30' is oriented so as to linearly translate along the actuator lever arm axis $A_L'$ instead of being oriented so as to pivotably rotate. Further, in this embodiment the actuator lever arm axis $A_L'$ is completely in line with the actuator housing axis $A_H$. This allows for the SMA actuator 24' to pull the connecting link 32 such that the actuator lever arm axis $A_L'$ is also completely in line with the connecting link axis $A_C$. Thus, with this embodiment of the SMA actuator 24', the actuator housing axis $A_H$, the actuator lever arm axis $A_L'$, and the connecting link axis $A_C$ can all be aligned or colinear during operation of the latch assembly 20.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation. In addition, the term "and/or" is to be construed as an inclusive OR. Therefore, for example, the phrase "A, B, and/or C" is to be interpreted as covering all the following: "A"; "B"; "C"; "A and B"; "A and C"; "B and C"; and "A, B, and C."

The invention claimed is:

1. A latch assembly, comprising:

a shape memory alloy (SMA) actuator having an actuator housing, an SMA wire, and an actuator lever arm, wherein the actuator lever arm is configured to pivotably rotate or linearly translate with respect to the actuator housing upon activation of the SMA wire;

a connecting link coupled to the actuator lever arm, wherein the connecting link is configured to translate linearly along a connecting link axis when the actuator lever arm pivotably rotates or linearly translates;

a striker coupled to the connecting link, wherein the striker is configured to rotate about a striker axis to engage a closing surface; and a decoupled interface between the striker and the shape memory alloy (SMA) actuator, wherein the decoupled interface decouples movement of the striker from movement of the SMA wire, by decoupling movement between the connecting link and the striker, between the connecting link and the actuator lever arm, or between the connecting link and both of the striker and the actuator lever arm.

2. The latch assembly of claim 1, wherein the connecting link includes a wrapping end to couple the actuator lever arm.

3. The latch assembly of claim 1, wherein at least a portion of the shape memory alloy (SMA) wire runs parallel to an actuator housing axis that extends along a longest length of the actuator housing.

4. The latch assembly of claim 1, wherein the actuator lever arm is configured to pivotably rotate with respect to the actuator housing.

5. The latch assembly of claim 4, wherein an actuation range for pivotable rotation of the actuator lever arm is between 10° and 25°, inclusive.

6. The latch assembly of claim 5, wherein the actuation range overlaps an actuator lever arm axis, and the actuator lever arm axis is orthogonal to an actuator housing axis that extends along a longest length of the actuator housing.

7. The latch assembly of claim 1, wherein an actuator housing axis that extends along a longest length of the actuator housing is aligned with the connecting link axis.

8. The latch assembly of claim 7, wherein the actuator lever arm linearly translates upon activation of the shape memory alloy (SMA) wire.

9. The latch assembly of claim 1, wherein the shape memory alloy (SMA) actuator includes a return spring, and wherein the decoupled interface allows for the return spring and the SMA wire to return to original positions at different rates of speed.

10. The latch assembly of claim 1, wherein the striker includes a locking pawl and a connection extension.

11. The latch assembly of claim 10, wherein the connection extension has an open track to slidingly accommodate the connecting link.

12. A center console for a vehicle, comprising the latch assembly of claim 1.

13. The center console of claim 12, wherein the closing surface is located on an armrest.

14. A glovebox for a vehicle, comprising the latch assembly of claim 1.

* * * * *